US011715897B2

(12) United States Patent
Huang et al.

(10) Patent No.: US 11,715,897 B2
(45) Date of Patent: Aug. 1, 2023

(54) POWER CONNECTOR SOCKET

(71) Applicant: ADVANCED-CONNECTEK INC., New Taipei (TW)

(72) Inventors: Sheng-Hsiang Huang, New Taipei (TW); Yu-Feng Ke, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 30 days.

(21) Appl. No.: 17/192,270

(22) Filed: Mar. 4, 2021

(65) Prior Publication Data

US 2021/0281000 A1 Sep. 9, 2021

(30) Foreign Application Priority Data

Mar. 5, 2020 (TW) ..... 109202473

(51) Int. Cl.
*H01R 4/38* (2006.01)
*H01R 13/11* (2006.01)
*H01R 13/50* (2006.01)

(52) U.S. Cl.
CPC ..... *H01R 13/11* (2013.01); *H01R 13/50* (2013.01); *H01R 2201/26* (2013.01)

(58) Field of Classification Search
CPC ..... H01R 13/622; H01R 2103/00; H01R 13/6315; H01R 33/22; H01R 13/6277; H01R 33/94; F21S 6/002
See application file for complete search history.

(56) References Cited

U.S. PATENT DOCUMENTS 9,325,095 B2 * 4/2016 Glick ..... H01R 13/187

* cited by examiner

*Primary Examiner* — Phuong Chi Thi Nguyen
(74) *Attorney, Agent, or Firm* — Muncy, Geissler, Olds & Lowe, P.C.

(57) ABSTRACT

A power connector socket includes a main body and a lamella cage. The main body includes a socket, an opening at a side portion of the socket, and a chamber inside the socket. The lamella cage passes through the socket. The lamella cage includes a ring portion and contact lamellae. The contact lamellae outwardly extend from a side portion of the ring portion and are annularly arranged. The ring portion is in an inner side of the chamber. One of two ends of each of the contact lamellae includes a fixed end formed on the ring portion, a free end outwardly extends from the other end of each of the contact lamellae, and the free ends are positioned at a portion of the main body adjacent to the opening.

13 Claims, 11 Drawing Sheets

POWER CONNECTOR SOCKET

CROSS-REFERENCE TO RELATED APPLICATION

This non-provisional application claims priority under 35 U.S.C. § 119(a) to Patent Application No. 109202473 filed in Taiwan, R.O.C. on Mar. 5, 2020, the entire contents of which are hereby incorporated by reference.

FIELD OF THE INVENTION

The instant disclosure relates to a power connector, and more particular to a power connector socket.

BACKGROUND

The battery of the electric vehicle can be charged by inserting an electrical plug connector into the electrical receptacle connector in the electric vehicle. The electrical plug connector has a standardized shape and five main bodies. Therefore, the electrical receptacle connector on the electric vehicle and the electrical plug connector of the charging gun at the charging station are mated with each other and connected to each other. Specifically, the five conductive bodies (pins) of the electrical plug connector are respectively two AC power pins, a ground pin, a proximity detection pin, and a pilot control pin.

An electrical receptacle connector known to the inventor has a main body, a crown pin, and an outer cover. After the crown pin is inserted into the chamber of the socket at one end of the main body, the crown pin is fixed by the outer cover to prevent the crown pin from detaching off the chamber. Hence, three components, i.e., the main body, the crown pin, and the outer cover are used to form a connector assembly.

SUMMARY OF THE INVENTION

However, the outer cover has to be manufactured and assembled additionally, thus increasing the manufacturing and assembling costs. Moreover, the outer cover is not easy to be processed, thus increasing the defect rate of the product.

One embodiment of the instant disclosure provides a power connector socket. The power connector socket comprises a main body and a lamella cage. The main body comprises a socket, an opening at a side portion of the socket, and a chamber inside the socket. The lamella cage passes through the socket. The lamella cage comprises a ring portion and a plurality of contact lamellae. The contact lamellae outwardly extend from a side portion of the ring portion and are annularly arranged. The ring portion is in an inner side of the chamber. One of two ends of each of the contact lamellae comprises a fixed end formed on the ring portion, a free end outwardly extends from the other end of each of the contact lamellae, and the free ends are positioned at a portion of the main body adjacent to the opening.

In one or some embodiments, the free ends obliquely extend to form a cone structure, and each of the free ends extends outwardly and obliquely from a middle section of the corresponding contact lamella.

In one or some embodiments, the main body comprises a cone groove, the cone groove is formed at the inner side of the chamber and adjacent to the opening, and the free ends are positioned at the cone groove.

In one or some embodiments, the main body comprises an inner blocking wall and an outer blocking wall respectively formed at two ends of the chamber, a side portion of each of the fixed ends abuts against the inner blocking wall, and a side portion of each of the free ends abuts against the outer blocking wall.

In one or some embodiments, an outer diameter of the ring portion is equal to or less than an inner diameter of the opening, and an outer diameter of the free end of each of the contact lamellae is greater than the inner diameter of the opening.

In one or some embodiments, the lamella cage contact lamellae comprise a plurality of contact portions extending toward an inner portion of the socket. The contact portions are on a first position adjacent to the fixed end of each of the contact lamellae and on a second position of a middle portion of each of the contact lamellae.

In one or some embodiments, the lamella cage comprise a plurality of long suspension arms and a plurality of short suspension arms. The long suspension arms and the short suspension arms are alternately and spacedly arranged and extending outwardly from the side portion of the ring portion.

In one or some embodiments, the contact portions comprise a plurality of first contacts and a plurality of second contacts. The first contacts are at the first positions of the short suspension arms, and the second contacts are at the second positions of the long suspension arms.

According to one or some embodiments of the instant disclosure, the ring portion of the lamella cage can be assembled into the socket by a reverse assembling manner. Since the contact lamellae of the lamella cage extend outwardly and obliquely, the contact lamellae can be positioned in the socket. Hence, the power connector can be assembled by the main body and the lamella cage, thereby reducing the material costs and the assembling time of the product. Namely, the power connector is a two-piece structure, and as compared with a three-piece power connector, the manufacturing cost and the assembling time for the additional third piece, the outer cover, can be saved.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
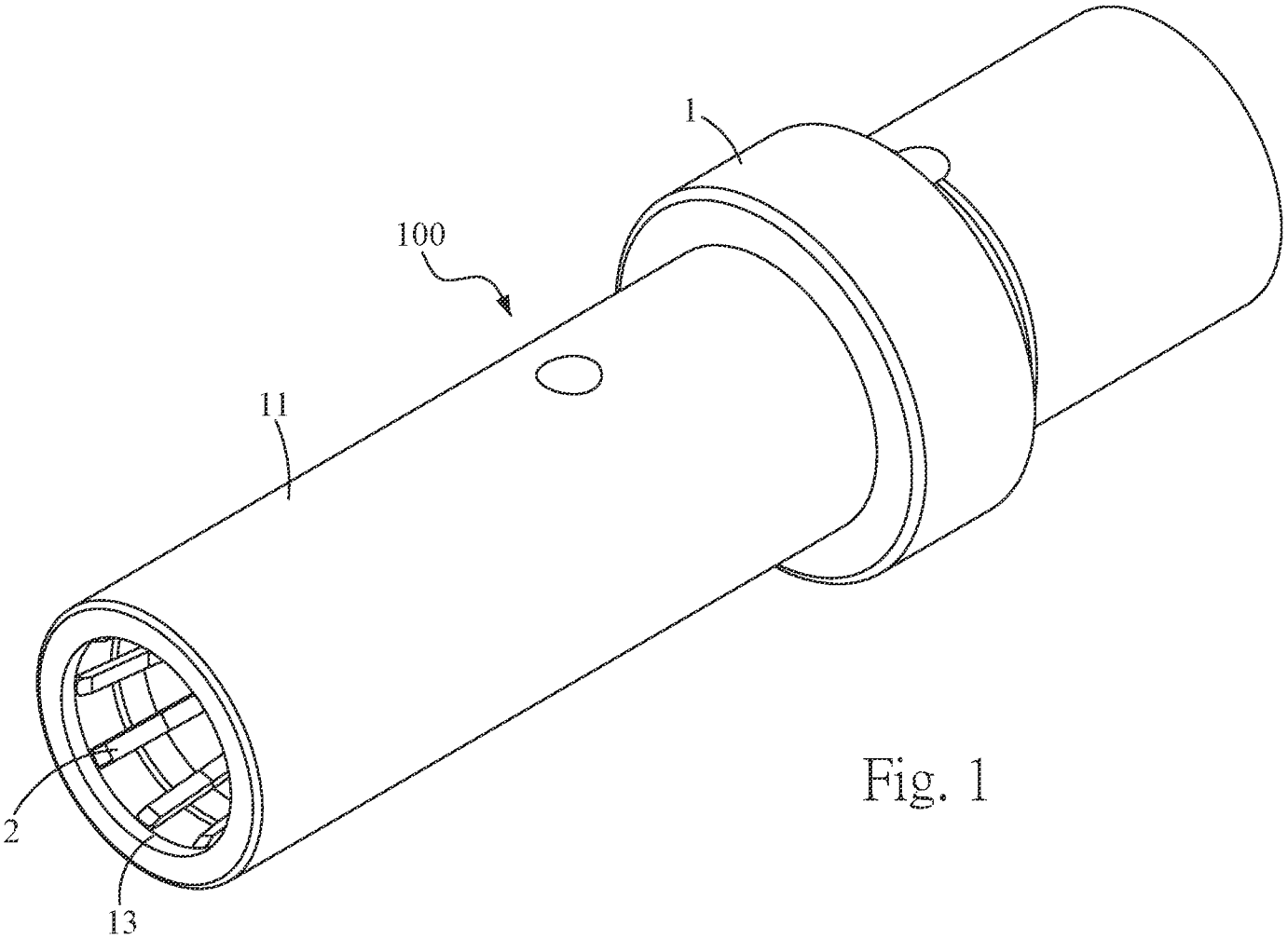
FIG. 1 illustrates a perspective view of a power connector socket according to an exemplary embodiment of the instant disclosure.
Figure 2:
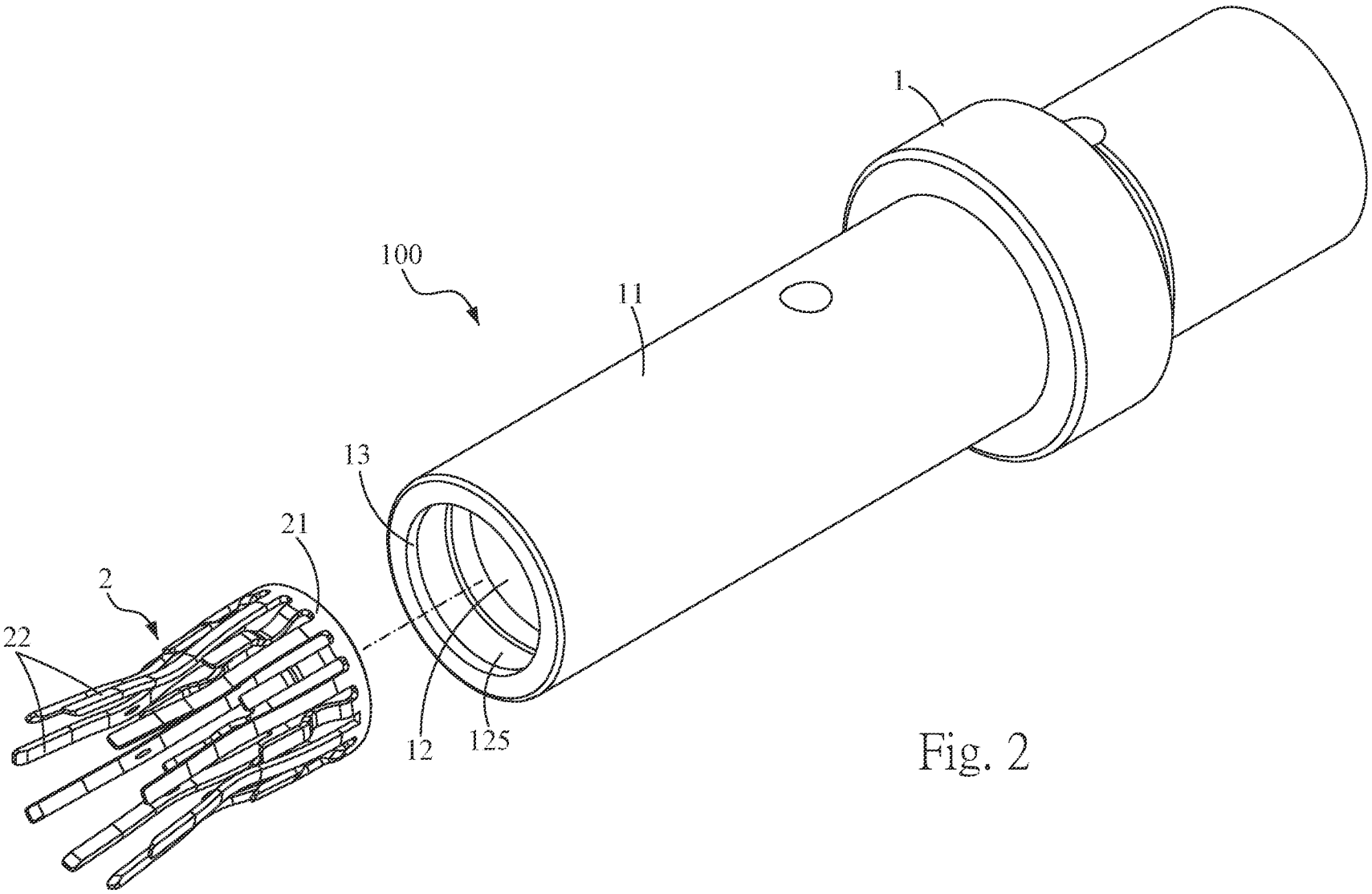
FIG. 2 illustrates an exploded view of the power connector socket of the exemplary embodiment.
Figure 3:
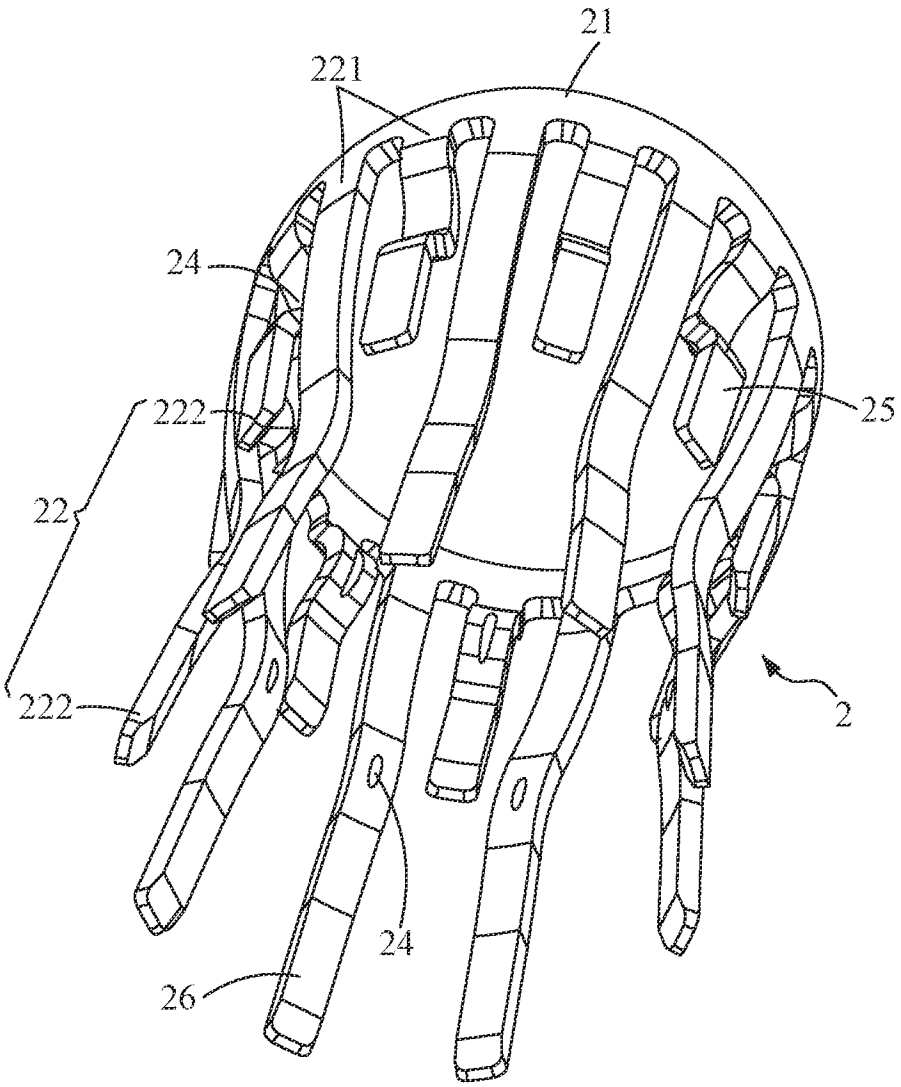
FIG. 3 illustrates a perspective view of a lamella cage of the power connector socket of the exemplary embodiment.
Figure 4:
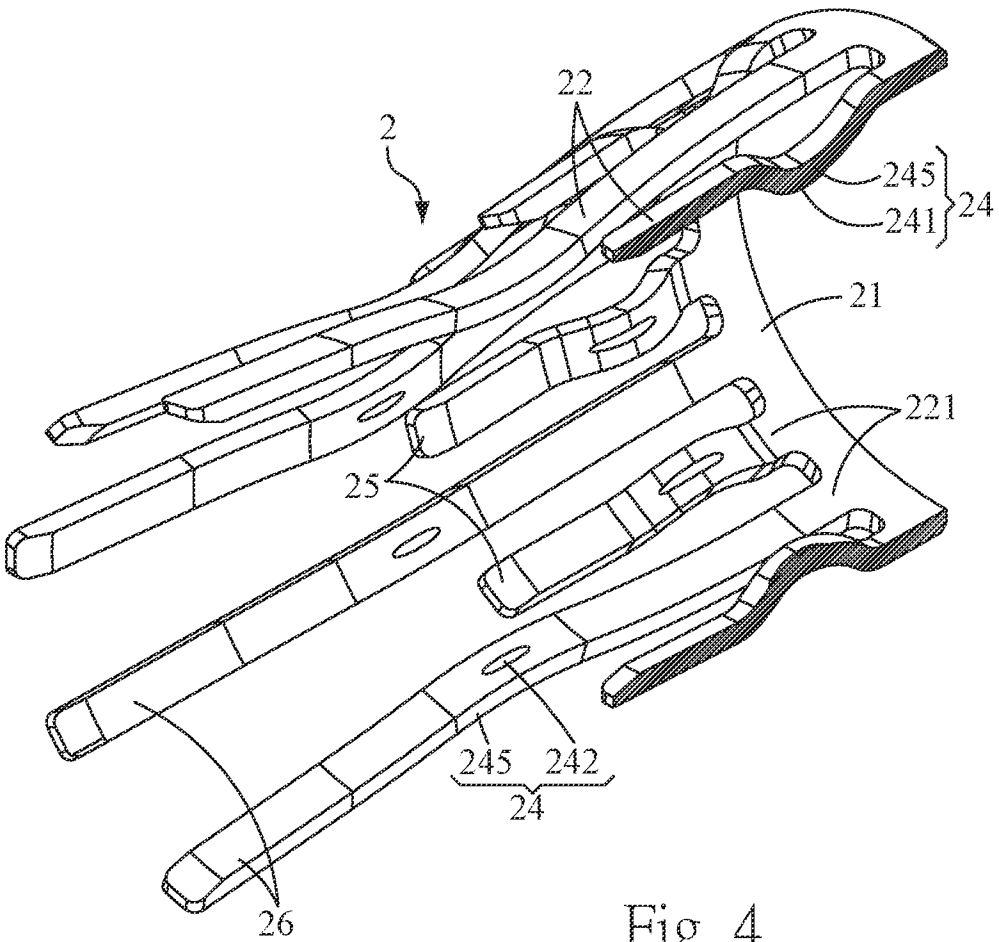
FIG. 4 illustrates a perspective sectional view of the lamella cage of the power connector socket of the exemplary embodiment.
Figure 5:
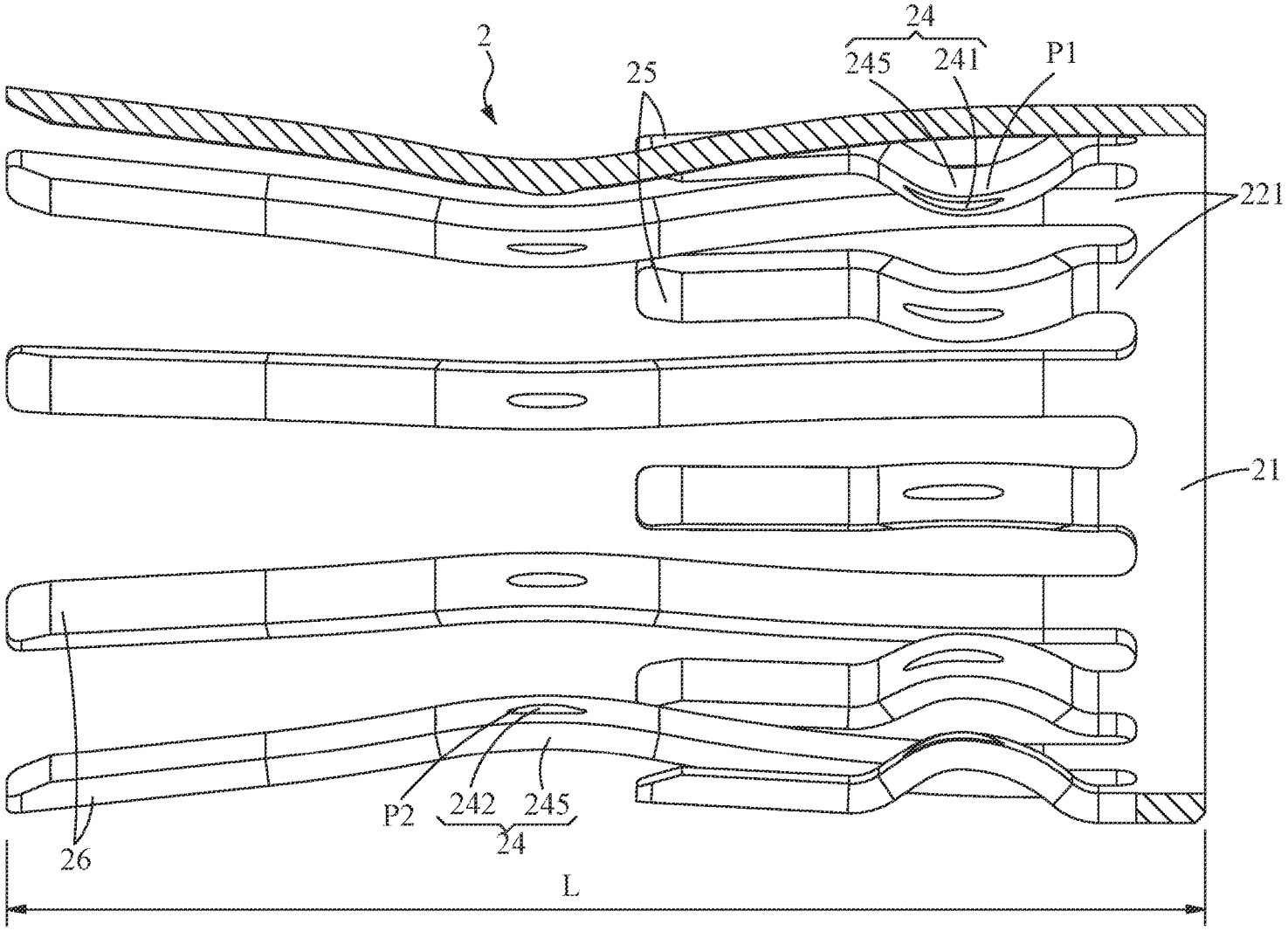
FIG. 5 illustrates a cross-sectional view of the lamella cage of the power connector socket of the exemplary embodiment.
Figure 6:
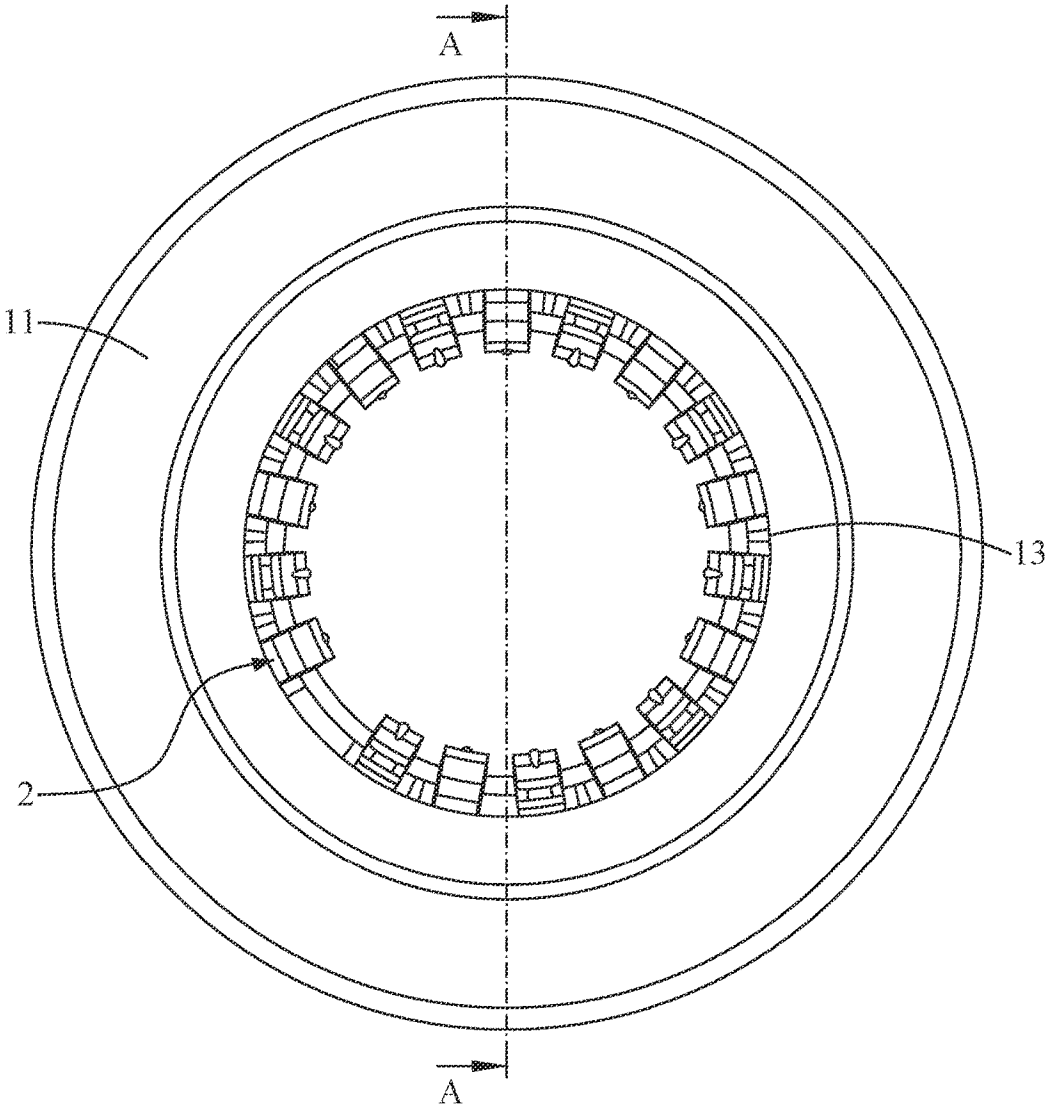
FIG. 6 illustrates a front schematic view of the power connector socket of the exemplary embodiment.
Figure 7:
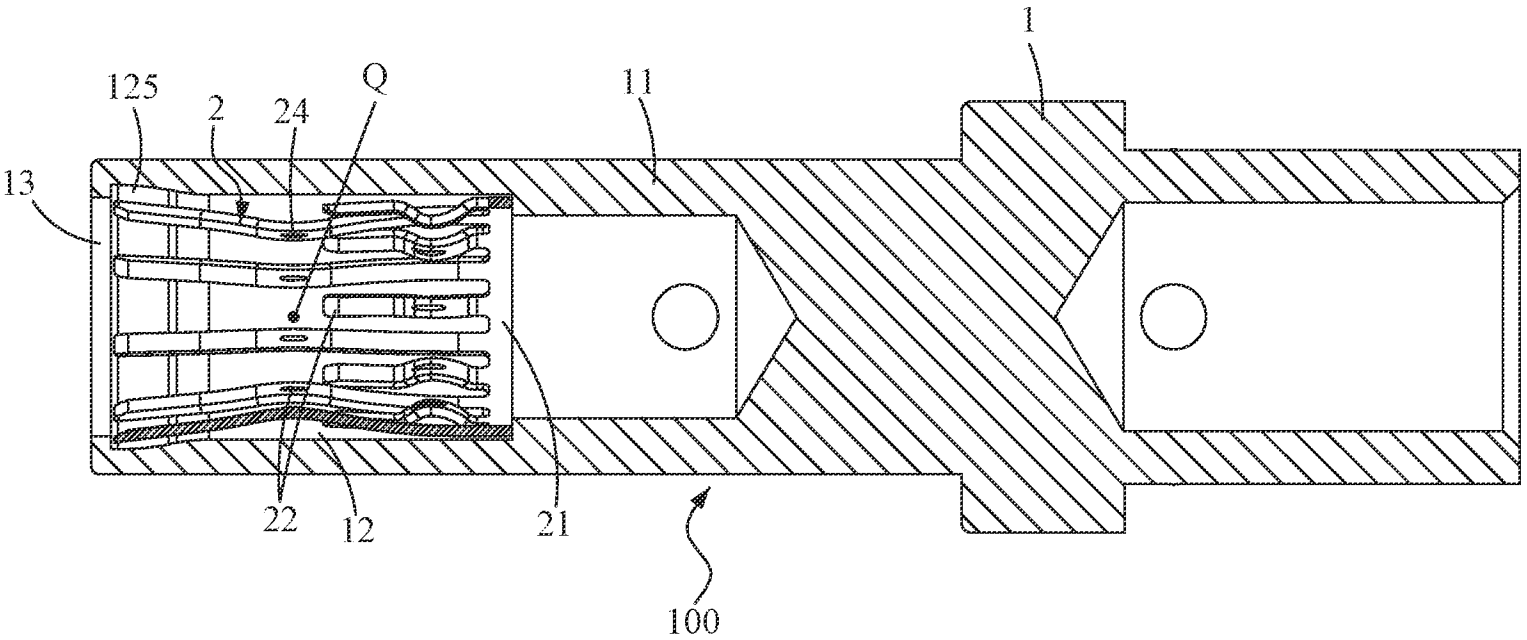
FIG. 7 illustrates a cross-sectional view along the line AA shown in FIG. 6.
Figure 8:
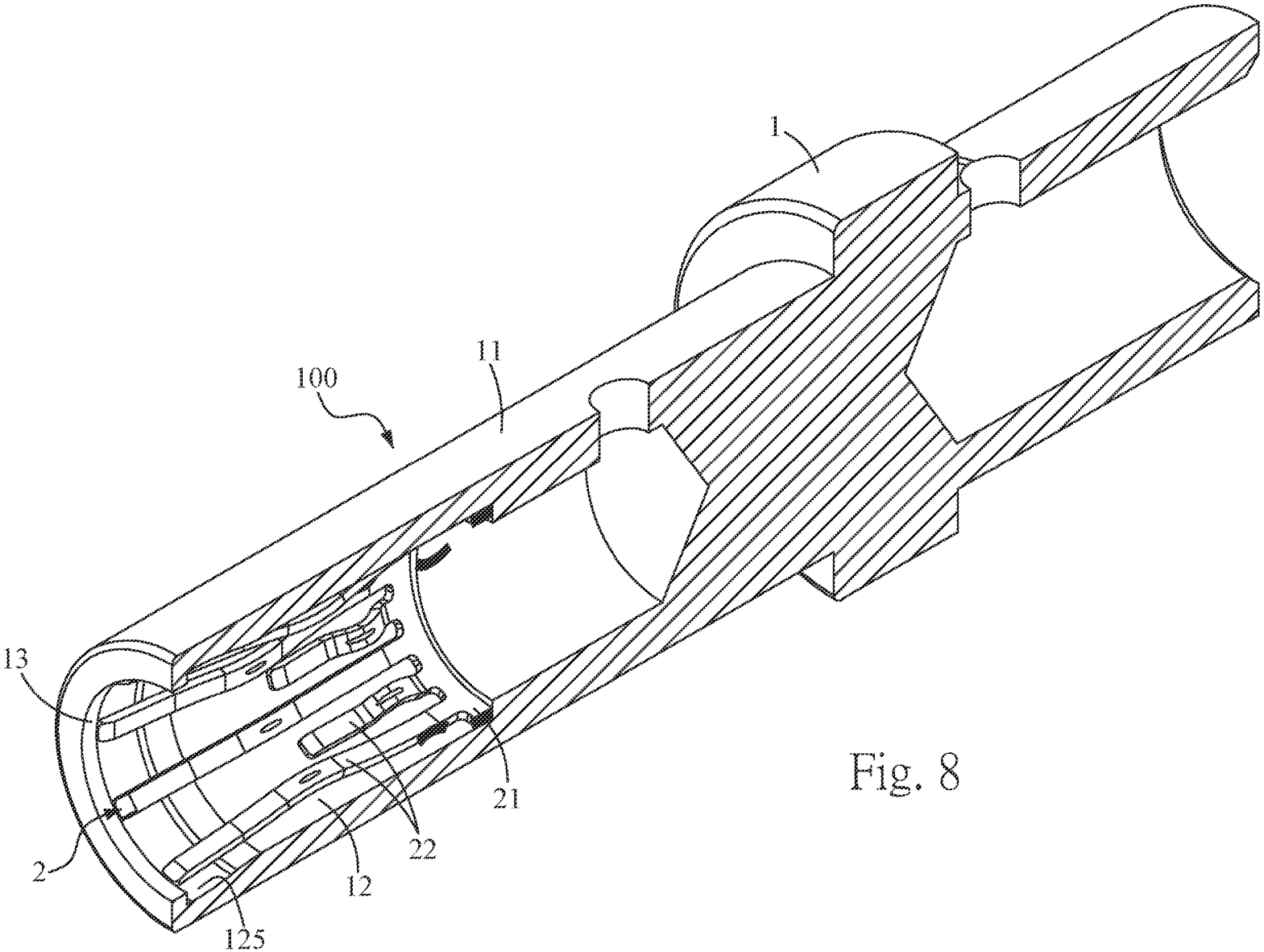
FIG. 8 illustrates a perspective sectional view of the power connector socket of the exemplary embodiment.
Figure 11:
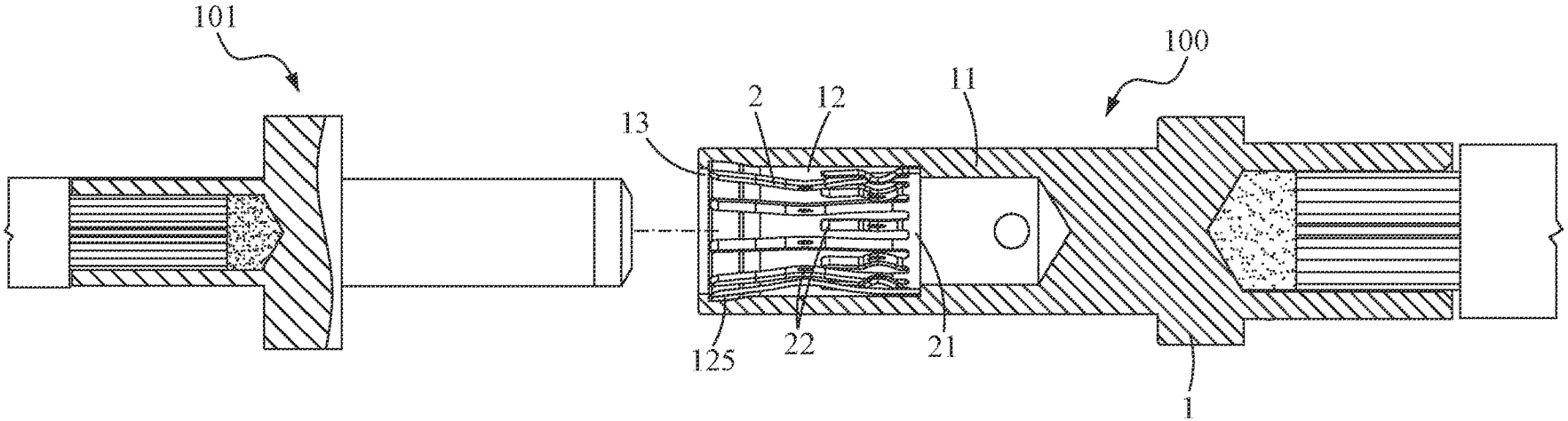
FIG. 11 illustrates a schematic side view showing the power connector socket of the exemplary embodiment is to be mated with a corresponding electrical plug connector.

Please refer to FIGS. 1 to 8. A power connector according to an exemplary embodiment of the instant disclosure is illustrated. FIG. 1 illustrates a perspective view of a power connector socket according to an exemplary embodiment of the instant disclosure. FIG. 2 illustrates an exploded view of the power connector socket of the exemplary embodiment. FIG. 3 illustrates a perspective view of a lamella cage of the power connector socket of the exemplary embodiment. FIG. 4 illustrates a perspective sectional view of the lamella cage of the power connector socket of the exemplary embodiment. FIG. 5 illustrates a cross-sectional view of the lamella cage of the power connector socket of the exemplary embodiment. FIG. 6 illustrates a front schematic view of the power connector socket of the exemplary embodiment. FIG. 7 illustrates a cross-sectional view along the line AA shown in FIG. 6. FIG. 8 illustrates a perspective sectional view of the power connector socket of the exemplary embodiment. In this embodiment, the power connector socket is a receptacle connector 100 provided for being inserted and contacted by an electrical plug connector (as shown in FIG. 11). The power connector socket comprises a main body 1 and a lamella cage 2. The power connector socket may be served as the charging dock of an automobile electrical connector (e.g., electric vehicle, hybrid vehicle, or electric car), but embodiments are not limited thereto; the power connector may be applied in other fields having power transmission needs.

In this embodiment, one end of the main body 1 comprises the socket 11, an opening 111 at a side portion of the socket 11, and a chamber 12 inside the socket 11.

In this embodiment, the lamella cage 2 passes through the socket 11. The lamella cage 2 comprises a ring portion 21 and a large number of contact lamellae 22.

In this embodiment, the ring portion 21 is in an inner side of the chamber 12. The contact lamellae 22 outwardly extend from a side portion of the ring portion 21, and the contact lamellae 22 are annularly arranged on the side portion of the ring portion 21. One of two ends of each of the contact lamellae 22 comprises a fixed end 221 on the ring portion 21 (the material belt), a free end 222 outwardly extends from the other end of each of the contact lamellae 22, and the free ends 222 are positioned at a portion of the main body 1 adjacent to the opening 13.

In this embodiment, more specifically, the contact lamellae 22 are curved, and the lamella cage 2 forms a cylinder structure. One end of each of the contact lamellae 22 is connected to the material belt (the ring portion 21), and the other end of each of the contact lamellae 22 extends outwardly and obliquely. The free ends 222 obliquely extend to form a cone structure 225. Each of the free ends 222 extends outwardly and obliquely from a middle section 223 of the corresponding contact lamella 22. Moreover, the main body 1 comprises a cone groove 125. The cone groove 125 is formed at the inner side of the chamber 12 and adjacent to the opening 13. The free ends 222 are positioned at the cone groove 125.

In this embodiment, more specifically, the main body 1 comprises an inner blocking wall 121 and an outer blocking wall 122 respectively formed at two ends of the chamber 12. A side portion of each of the fixed ends 221 abuts against the inner blocking wall 121, and a side portion of each of the free ends 222 abuts against the outer blocking wall 122. The inner blocking wall 121 and the outer blocking wall 122 limit the lamella cage 2 so as to prevent the lamella cage 2 from detaching off the chamber 12.

In this embodiment, more specifically, an outer diameter 21D of the ring portion 21 is equal to or less than an inner diameter 13*d* of the opening 13, and an outer diameter 222D of the free end 222 of each of the contact lamellae 22 is greater than the inner diameter 13*d* of the opening 13. Accordingly, the end portion of the ring portion 21 can be aimed at the opening 13 of the socket 11 and inserted into the chamber 12 conveniently, and the free ends 222 are then expanded outwardly to abut against an inner portion of the opening 13.

Figure 9:
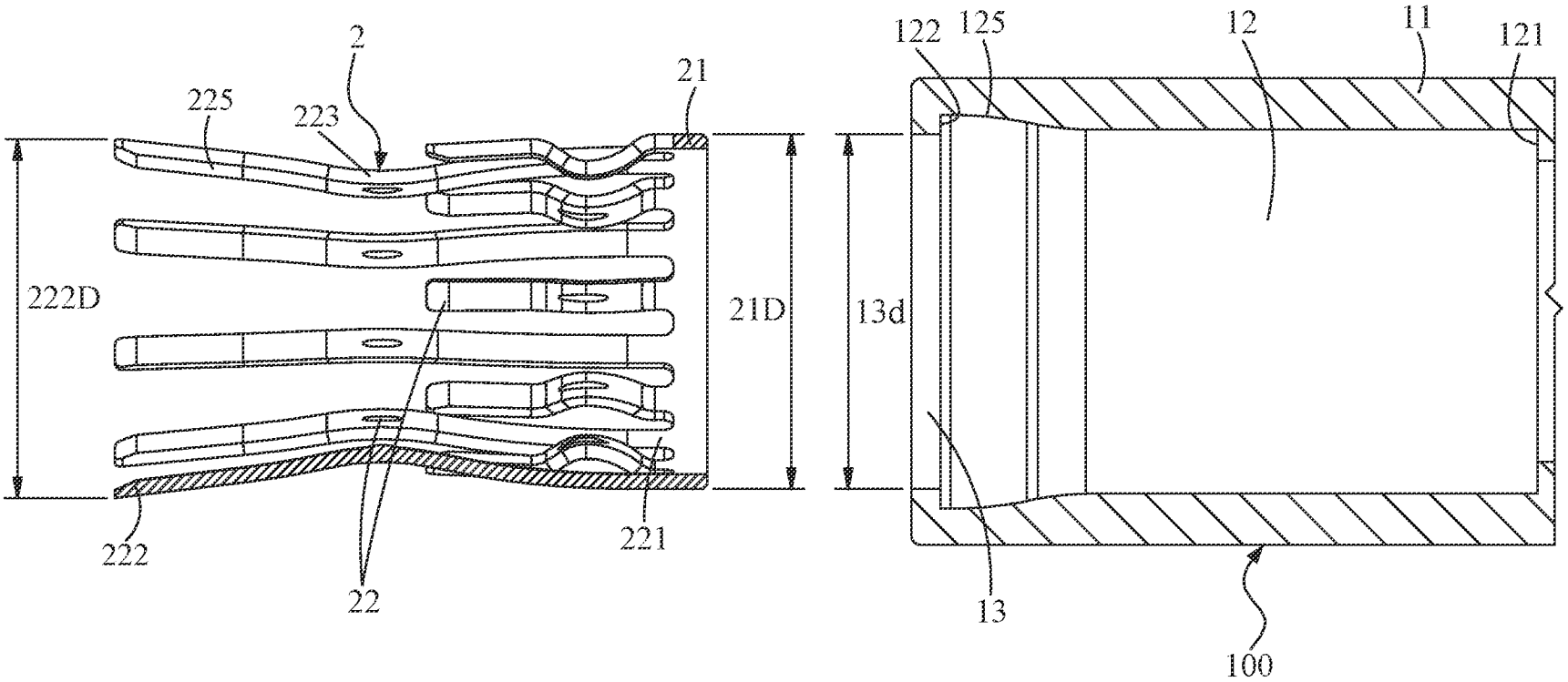
FIG. 9 illustrates an enlarged exploded view of the power connector socket shown in FIG. 6.
Figure 10:
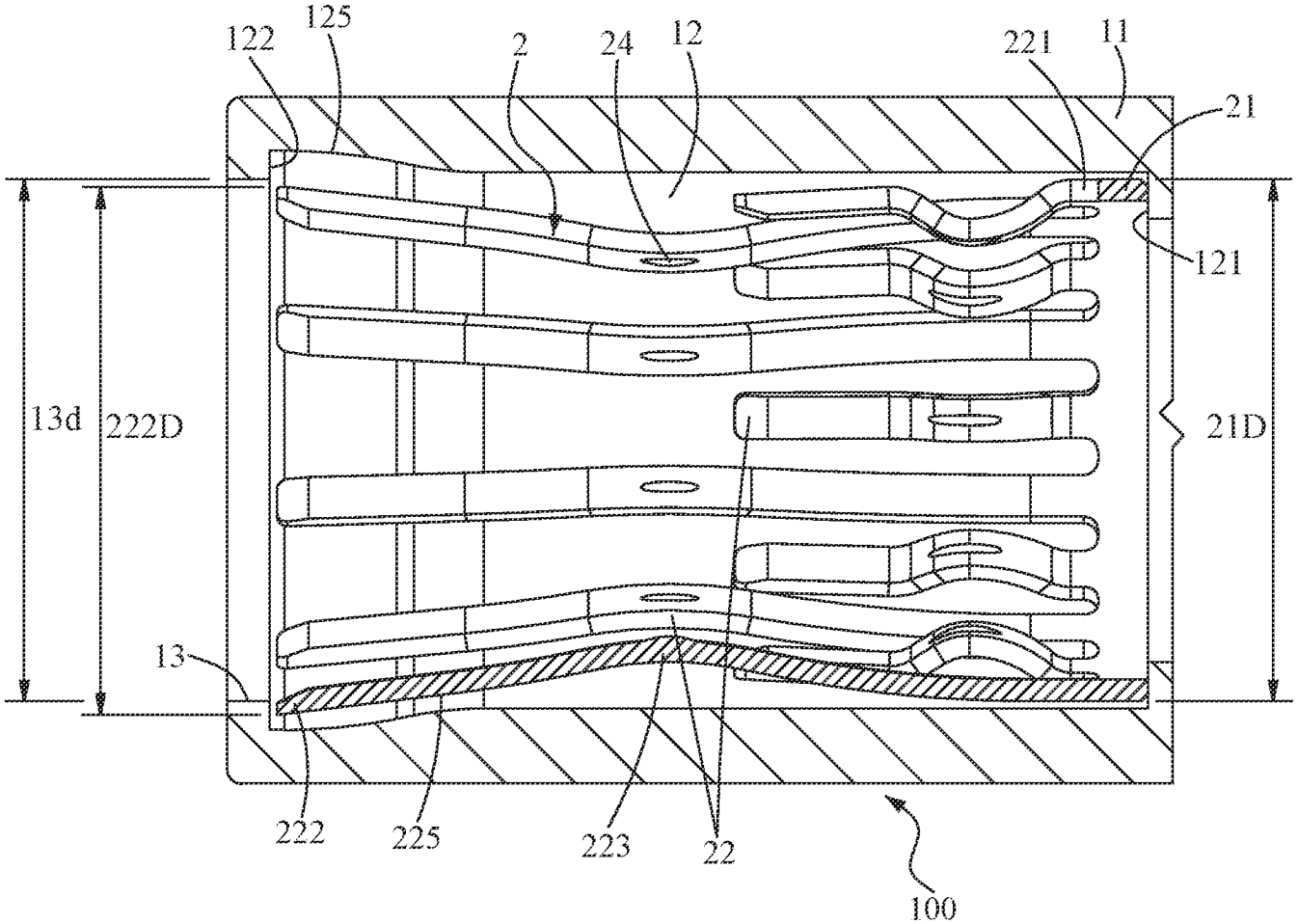
FIG. 10 illustrates an enlarged assembled view of the power connector socket shown in FIG. 6.

Please refer to FIGS. 6, 9, and 10. FIG. 9 illustrates an enlarged exploded view of the power connector shown in FIG. 6. FIG. 10 illustrates an enlarged assembled view of the power connector shown in FIG. 6. In this embodiment, the way that the ring portion 21 of the lamella cage 2 is inserted into the socket 11 of the main body 1 is a reverse assembling manner. By assembling the lamella cage 2 with the main body 1 to form the power connector, the manufacturing costs and the assembling time can be reduced. With the outwardly extending structure of the contact lamellae 22 of the lamella cage 2, the contact lamellae 22 can be positioned in the socket 11. Conversely, in a common forward assembling manner, the contact lamellae 22 are aimed at the socket 11 and inserted into the socket 11.

In this embodiment, the outer cover mentioned in the power connector known to the inventor can be omitted. In this embodiment, the lamella cage 2 can be directly inserted into the main body 1, and the contact lamellae 22 of the lamella cage 2 abut against the main body 1, such that the contact lamellae 22 can be positioned with the main body 1. Hence, the costs for the outer cover can be saved. The power connector can be formed by the main body 1 and the lamella cage 2; thereby reducing the manufacturing costs and the assembling time for the product.

In this embodiment, more specifically, the lamella cage 2 comprise a plurality of contact portions 24 extending toward an inner portion (e.g., the center point Q) of the socket 11. The contact portions 24 are on a first position P1 adjacent to the fixed end 221 of each of the contact lamellae 22 and on a second position P2 of a middle portion of each of the contact lamellae 22.

In this embodiment, more specifically, the first position P1 is defined as a position of the contact lamella 22 adjacent to the fixed end 221 of the contact lamella 22, and the second position P2 is defined as the position of the middle portion of the contact lamella 22. The first position P1 is different from the second position P2. A length from the opening 13 of the socket 11 to the second position P2 is less than a length from the opening 13 of the socket 11 to the first position P1. The second position P2 is on the portion of the contact lamella 22 adjacent to the opening 111 of the socket 11, and the first position P1 is on the portion of the contact lamella 22 at the inner portion of the socket 11.

In this embodiment, more specifically, the fixed end 221 of one of two ends of each of the contact lamellae 22 is on the ring portion 21, and the free end 222 extends outwardly from the other end of each of the contact lamellae 22, so that a suspension arm structure is formed. Hence, as compared with the configuration known to the inventor, i.e., the lamella cage having two ring portions as well as several contact lamellae connected between the two ring portions, the suspension arm structure of the embodiment(s) can provide a better elastic force.

In this embodiment, more specifically, the lamella cage 2 comprise a plurality of long suspension arms 26 (long claws) and a plurality of short suspension arms 25 (short claws), and the length of the long suspension arm 26 is greater than the length of the short suspension arm 25, but embodiments are not limited thereto. In some embodiments, the lengths of the contact lamellae 22 may be the same; that is, all the contact lamellae 22 may be of the configuration of the short suspension arm 25 (short claws) or may be of the configuration of the long suspension arm 26 (long claws), as shown in FIGS. 12 and 13, respectively.

In this embodiment, more specifically, the short suspension arms 25 and the long suspension arms 26 are spacedly arranged on the side portion of the ring portion 21, Furthermore, the short suspension arms 25 and the long suspension arms 26 are alternately arranged on the side portion of the ting portion 21 to form a circular array.

In this embodiment, more specifically, the contact portions 24 comprise a plurality of first contacts 241 and a plurality of second contacts 242. The first contacts 241 may be, but not limited to, at the first positions of the short suspension arms 25. The second contacts 242 may be, but not limited to, at the second positions P2 of the long suspension arms 26.

In this embodiment, a lamella cage 2 having a plurality of contacts at different positions may be provided, and the lamella cage 2 can be replaced with another lamella cage 2 having a plurality of contacts at different positions according to requirements. Therefore, for users having requirements in different contact distances, electrical plug connectors 101 with insertion pins in different lengths can be used.

In this embodiment, more specifically, each of the contact portions 24 comprises a protruding portion 245, and the protruding portion 245 bends and protrudes toward a center point Q of the socket 11 from the contact lamella 22, The orientation of the protruding portions 245 of the first contacts 241 for contacting the insertion pin of the electrical plug connector 101 may be adjusted to be flat or stiff, so that the mating/unmating force can be controlled properly. Hence, the force for inserting the insertion pin of the electrical plug connector 101 into the receptacle connector (the mating force) is smaller, while the force for pulling the insertion pin of the electrical plug connector 101 out of the receptacle connector (the unmating force) is larger.

The short suspension arms 25 and the long suspension arms 26 are respectively provided with the first contacts 241 and the second contacts 242 in different positions, thereby ensuring the contact between the insertion pin of the electrical plug connector 101 and the contact portions 24 of the lamella cage 2, thus preventing the insertion pin of the electrical plug connector 101 from detaching off the contact portion 24 of the lamella cage 2 or preventing the insertion pin of the electrical plug connector 101 from not contacting the contact portion 24 of the lamella cage 2, That is, the first contact 241 and the second contact 242 at different positions contact the outer peripheral surface of the insertion pin of the electrical plug connector 101. Accordingly, when one of the contacts (the first contact 241 or the second contact 242) is detached off or does not contact the insertion pin of the electrical plug connector 101, the other contact (the first contact 241 or the second contact 242) still closely contacts the insertion pin of the electrical plug connector 101.

The short suspension arm 25 and the long suspension arm 26 have different lengths and different moment arms. The short suspension arm 25 has a shorter moment arm, and the elastic force provided by the short suspension arm 25 for fixing the insertion pin of the electrical plug connector 101 is higher. Therefore, the short suspension arm 25 would be worn and damaged easily, as compared with the long suspension arm 26. Conversely, the long suspension arm 26 has a longer moment arm, and the elastic force provided by the long suspension arm 26 for fixing the insertion pin of the electrical plug connector 101 is lower. Accordingly, after the power connector is used for a long period of time, the short suspension arms 25 may be detached off or not contact the insertion pin of the electrical plug connector 101, while the long suspension arms 26 still contact the insertion pin of the electrical plug connector 101.

In this embodiment, the end of the main body 1 opposite to the opening 13 of the main body 1 has a wire connection hole. The wire connection hole is filled with a conductive medium and is inserted by a power supply wire.

According to one or some embodiments of the instant disclosure, the ring portion of the lamella cage can be assembled into the socket by a reverse assembling manner. Since the contact lamellae of the lamella cage extend outwardly and obliquely, the contact lamellae can be positioned in the socket. Hence, the power connector can be assembled by the main body and the lamella cage, thereby reducing the material costs and the assembling time of the product. Namely, the power connector is a two-piece structure, and as compared with a three-piece power connector, the manufacturing cost and the assembling time for the additional third piece, the outer cover, can be saved.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A power connector socket, comprising:

a main body comprising a socket, an opening at a side portion of the socket, and a chamber inside the socket; and a lamella cage passing through the socket, wherein the lamella cage comprises a ring portion and a plurality of contact lamellae outwardly extending from a side portion of the ring portion and annularly arranged, the ring portion is in an inner side of the chamber, one of two ends of each of the contact lamellae comprises a fixed end formed on the ring portion, a free end outwardly extends from other end of each of the contact lamellae, and the free ends are positioned at a portion of the main body adjacent to the opening, wherein the lamella cage comprise a plurality of contact portions extending toward an inner portion of the socket, the contact portions comprise a plurality of first contacts and a plurality of second contacts, the first contacts are at first positions, the second contacts are at second positions, and the first contacts and the second contacts are alternately and spacedly arranged.

2. The power connector socket according to claim 1, wherein the free ends obliquely extend to form a cone structure, and each of the free ends extends outwardly and obliquely from a middle section of the corresponding contact lamella.

3. The power connector socket according to claim 1, wherein the main body comprises a cone groove, the cone groove is formed at the inner side of the chamber and adjacent to the opening, and the free ends are positioned at the cone groove.

4. The power connector socket according to claim 1, wherein the main body comprises an inner blocking wall and an outer blocking wall respectively formed at two ends of the chamber, a side portion of each of the fixed ends abuts against the inner blocking wall, and a side portion of each of the free ends abuts against the outer blocking wall.

5. The power connector socket according to claim 1, wherein an outer diameter of the ring portion is equal to or less than an inner diameter of the opening, and an outer diameter of the free end of each of the contact lamellae is greater than the inner diameter of the opening.

6. The power connector socket according to claim 1, wherein the first contacts are on the first position adjacent to the fixed end of each of the contact lamellae and the second contacts are on the second position of a middle portion of each of the contact lamellae.

7. A power connector socket, comprising:

a main body comprising a socket, an opening at a side portion of the socket, and a chamber inside the socket; and a lamella cage passing through the socket, wherein the lamella cage comprises a ring portion and a plurality of contact lamellae outwardly extending from a side portion of the ring portion and annularly arranged, the ring portion is in an inner side of the chamber, one of two ends of each of the contact lamellae comprises a fixed end formed on the ring portion, a free end outwardly extends from other end of each of the contact lamellae, and the free ends are positioned at a portion of the main body adjacent to the opening, wherein the lamella cage comprise a plurality of long suspension arms and a plurality of short suspension arms, the long suspension arms and the short suspension arms are alternately and spacedly arranged and extending outwardly from the side portion of the ring portion.

8. The power connector socket according to claim 7, wherein the free ends obliquely extend to form a cone structure, and each of the free ends extends outwardly and obliquely from a middle section of the corresponding contact lamella.

9. The power connector socket according to claim 7, wherein the main body comprises a cone groove, the cone groove is formed at the inner side of the chamber and adjacent to the opening, and the free ends are positioned at the cone groove.

10. The power connector socket according to claim 7, wherein the main body comprises an inner blocking wall and an outer blocking wall respectively formed at two ends of the chamber, a side portion of each of the fixed ends abuts against the inner blocking wall, and a side portion of each of the free ends abuts against the outer blocking wall.

11. The power connector socket according to claim 7, wherein an outer diameter of the ring portion is equal to or less than an inner diameter of the opening, and an outer diameter of the free end of each of the contact lamellae is greater than the inner diameter of the opening.

12. The power connector socket according to claim 7, wherein the lamella cage comprise a plurality of contact portions extending toward an inner portion of the socket, the contact portions comprise a plurality of first contacts and a plurality of second contacts, the first contacts are at first positions, the second contacts are at second positions, and the first contacts and the second contacts are alternately and spacedly arranged.

13. The power connector socket according to claim 12, wherein the contact portions comprise a plurality of first contacts and a plurality of second contacts, the first contacts are at the first positions of the short suspension arms, and the second contacts are at the second positions of the long suspension arms.

* * * * *